US008199059B2

(12) United States Patent
Byun et al.

(10) Patent No.: US 8,199,059 B2
(45) Date of Patent: Jun. 12, 2012

(54) SLOT ANTENNA WITH STUBS

(75) Inventors: Woo Jin Byun, Daejeon (KR); Min Soo Kang, Daejeon (KR); Kwang Seon Kim, Daejeon (KR); Bong Su Kim, Daejeon (KR); Tae Jin Chung, Seoul (KR); Myung Sun Song, Seoul (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 389 days.

(21) Appl. No.: 12/613,193

(22) Filed: Nov. 5, 2009

(65) Prior Publication Data

US 2010/0156731 A1 Jun. 24, 2010

(30) Foreign Application Priority Data

Dec. 22, 2008 (KR) ..... 10-2008-0131182

(51) Int. Cl.
*H01Q 1/38* (2006.01)

(52) U.S. Cl. ..... 343/700 MS; 343/767; 343/846

(58) Field of Classification Search ..... 343/700 MS, 343/739, 767, 829, 846
See application file for complete search history.

(56) References Cited

U.S. PATENT DOCUMENTS

| | | | | |
|---|---|---|---|---|
| 5,905,472 | A * | 5/1999 | Wolfson et al. | 343/772 |
| 6,072,434 | A * | 6/2000 | Papatheodorou | 343/700 MS |
| 6,157,347 | A * | 12/2000 | Robertson | 343/772 |
| 6,492,947 | B2 * | 12/2002 | Anderson | 343/700 MS |
| 6,774,853 | B2 * | 8/2004 | Wong et al. | 343/700 MS |
| 6,995,711 | B2 * | 2/2006 | Killen et al. | 343/700 MS |
| 7,079,082 | B2 | 7/2006 | Iskander et al. | |
| 7,336,238 | B2 * | 2/2008 | Rawnick et al. | 343/846 |
| 7,362,273 | B2 * | 4/2008 | Sarehraz et al. | 343/700 MS |

FOREIGN PATENT DOCUMENTS

| | | |
|---|---|---|
| KR | 10-2006-0047567 | 5/2006 |
| KR | 10-2007-0033039 | 3/2007 |

OTHER PUBLICATIONS

Magdy F. Iskander et al., "Coaxial Continuous Transverse Stub (CTS) Array", IEEE Microwave and Wireless Components Letters, vol. 11, No. 12, Dec. 2001, 3 pages.

* cited by examiner

*Primary Examiner* — Tho G Phan
(74) *Attorney, Agent, or Firm* — Staas & Halsey LLP

(57) ABSTRACT

A slot antenna having stubs is provided, in which a strip transmission line for transmitting a transverse electromagnetic mode (TEM) signal is formed by using a multi-layered substrate, and a plurality of slots are used for the strip transmission line. Thus, an omnidirectional radiation pattern is obtained, and the directivity of the slot antenna is improved.

6 Claims, 4 Drawing Sheets

SLOT ANTENNA WITH STUBS

CROSS-REFERENCE TO RELATED PATENT APPLICATION

This application claims the benefit of Korean Patent Application No. 10-2008-0131182, filed on Dec. 22, 2008, in the Korean Intellectual Property Office, the disclosure of which is incorporated herein in its entirety by reference.

BACKGROUND OF THE INVENTION

1. Field of the Invention

The present invention relates to a slot antenna, and more particularly, to an edge-slot array antenna having stub on a planar dielectric substrate.

2. Description of the Related Art

A conventional continuous transverse stub (CTS) antenna minimizes losses of power and radiate in a direction perpendicular to the plane of the CTS antenna (that is, broadside) by using a radiation body that uses slots and includes stubs on a planar transmission line. However, it is difficult for this antenna structure to implement a circuit for signal feeding, impedance matching, and feeder termination.

A coaxial CTS array antenna using a coaxial cable provides omnidirectional radiation in multiple bands by using circular stubs having different sizes. However, because the coaxial CTS array antenna also performs signal feeding via a coaxial cable, it is not easy to both from a circuit for impedance matching and feeder termination and Integrate the coaxial CTS array antenna with a transceiver module.

SUMMARY OF THE INVENTION

The present invention provides a slot antenna having stubs, in which a strip transmission line for transmitting a transverse electromagnetic mode (TEM) signal is formed by using a multi-layered substrate, and a plurality of slots are placed on ground planes of the strip transmission line, thereby obtaining an omnidirectional radiation pattern and increasing the directivity of the slot antenna.

According to an aspect of the present invention, there is provided a slot antenna having stubs, the slot antenna including a dielectric substrate having a first region and a second region at both ends thereof and a third region between the first and second regions; at least one pair of stubs arranged at regular intervals on the third region of the dielectric substrate; and ground planes located on upper and lower surfaces of the dielectric substrate in regions ranging from ends of the third region to the stubs and connected to each other via a plurality of ground vias. In the first and second regions, a microstrip transmission line is formed. In the third region, a strip transmission line is formed.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE INVENTION

A slot antenna having stubs according to the present invention will now be described more fully with reference to the accompanying drawings, in which exemplary embodiments of the invention are shown.

Figure 1:
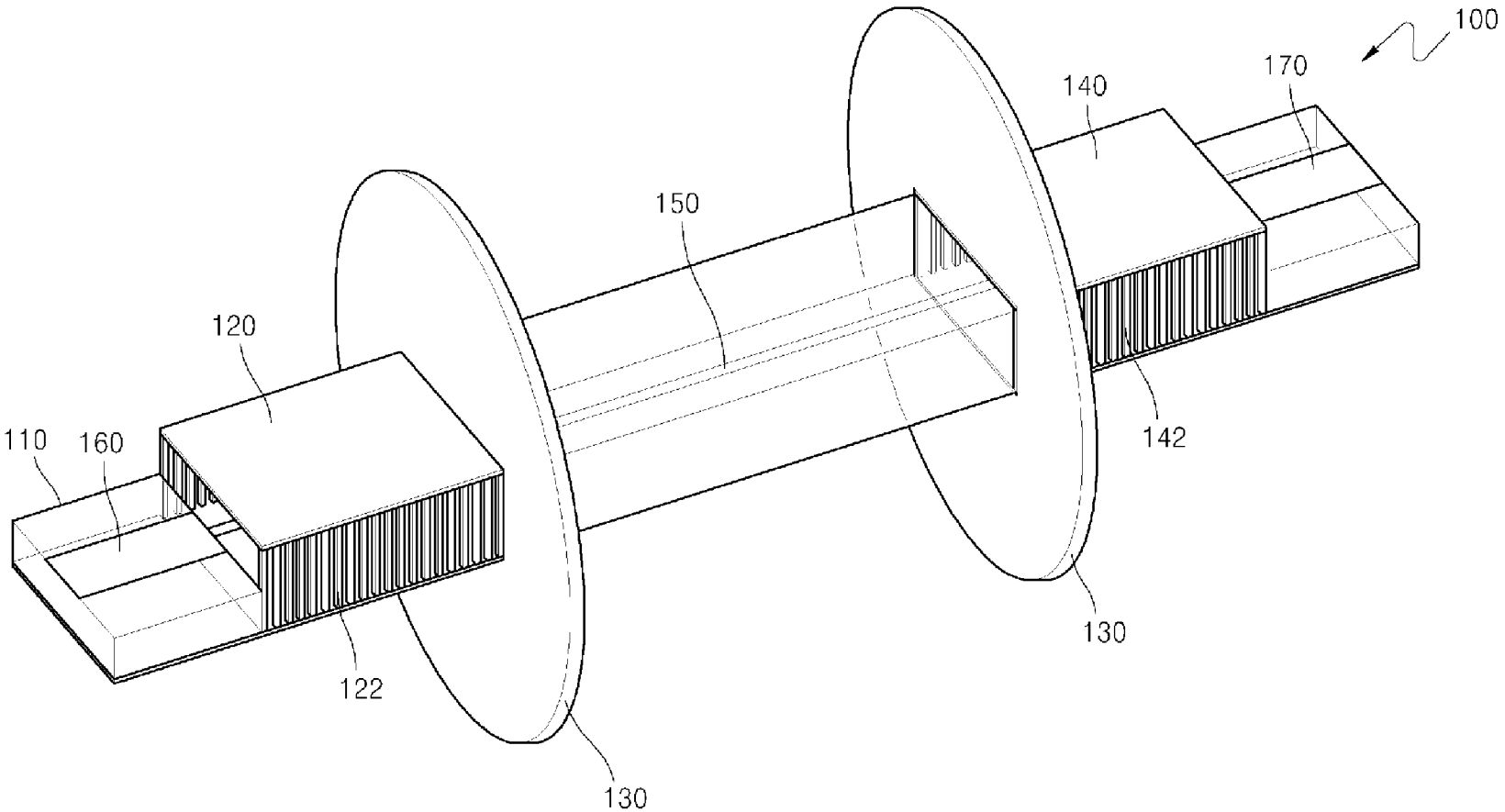
FIG. 1 is a perspective view of a slot antenna having stubs, according to an embodiment of the present invention.

FIG. 1 is a perspective view of a slot antenna 100 having stubs 130 according to an embodiment of the present invention. Referring to FIG. 1, the slot antenna 100 is an edge-slot array antenna that uses a dielectric substrate 110 and includes the stubs 130.

The slot antenna 100 includes a signal feeding unit and a feeder termination unit at both ends, respectively. Ground units 120 and 140 are located besides the signal feeding unit and the feeder termination unit, respectively, and the stubs 130 are installed at ends of the ground units 120 and 140, respectively. Micro-strip transmission lines 160 and 170 and a strip transmission line 150 are formed in the dielectric substrate 110. The strip transmission line 150 transmits a transverse electromagnetic mode (TEM) signal by using a multi-layered substrate.

The signal feeding unit and the feeder termination unit include planar transmission lines on the dielectric substrate 110 so as to facilitate integration of the slot antenna 100 with a transceiver module and implementation of an impedance matching circuit. The planar transmission lines may be the micro-strip transmission lines 160 and 170.

The ground units 120 and 140 have the dielectric substrate 110 between the two and each have upper and lower ground planes. A plurality of arranged ground vias 122 and 142 connect the upper and lower ground planes of each of the ground units 120 and 140. The ground vias 122 and 142 are closely spaced on the lateral sides of the dielectric substrate 110 and prevent signals from leaking through the lateral sides of the dielectric substrate 110, thus increasing the radiation efficiency of the antenna 100. High-gain omni-directional radiation patterns are obtained.

The stubs 130 are installed at an end of each of the ground units 120 and 140. Although the stubs 130 are circular in the present embodiment, the stubs 130 may have other various shapes such as a rectangle, a triangle, or the like.

A quasi-TEM signal for the micro-strip transmission line 160 is transformed into the TEM signal the transmission line 150. A part of the TEM signal is radiated through the stubs 130, and the residual is dissipated at the feeder termination unit.

The feeder termination unit has impedance that is the same as the characteristic impedance of the micro-strip transmission line 170, in order to prevent reflected waves from being generated due to impedance mismatching. This will be described in detail with reference to FIG. 3.

In general, both sides of the strip transmission line 150 are open. However, if the strip transmission line 150 having open sides is used for an antenna for transmitting signals in a specific direction, the efficiency of the antenna is rapidly decreased due to signal leakage. To address this problem, the ground vias 122 and 142 between the upper and lower ground planes of the ground units 120 and 140 are used in the present embodiment, thereby preventing signal leakage.

Figure 2:
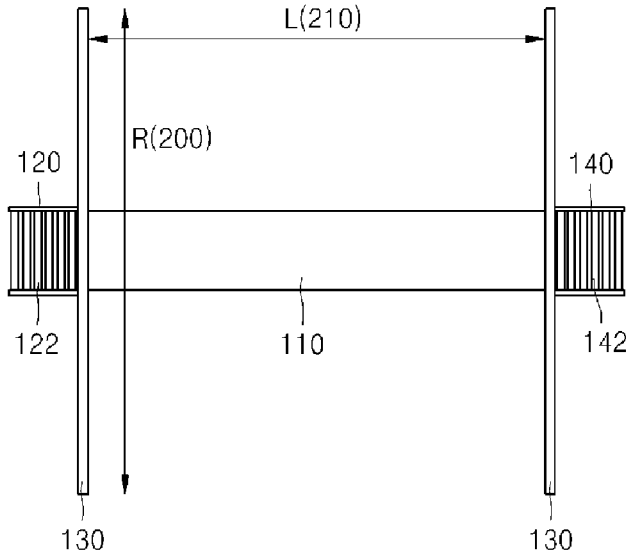
FIG. 2 illustrates cross-sections of a slot and ground planes of the slot antenna having the stubs illustrated in FIG. 1.

FIG. 2 illustrates cross-sections of a slot and the ground planes of the slot antenna 100 illustrated in FIG. 1.

Referring to FIG. 2, the dielectric substrate 110 is disposed between the ground plane 122 and 142, and the ground via 122 exists between upper and lower ground planes and likewise for the ground via 142. An interval (L) 210 between the two juxtaposed stubs 130 and a length (R) 200 of each of the stubs 130 are inversely proportional to an operating frequency. In other words, as the frequency is increased, the interval 210 and the length 200 are decreased.

To prevent signal leakage, intervals between adjacent ground vias 122 and 142 are no more than 1/10 of a guided wavelength ($\lambda_g$) (that is, no more than $\lambda_g/10$).

Figure 3:
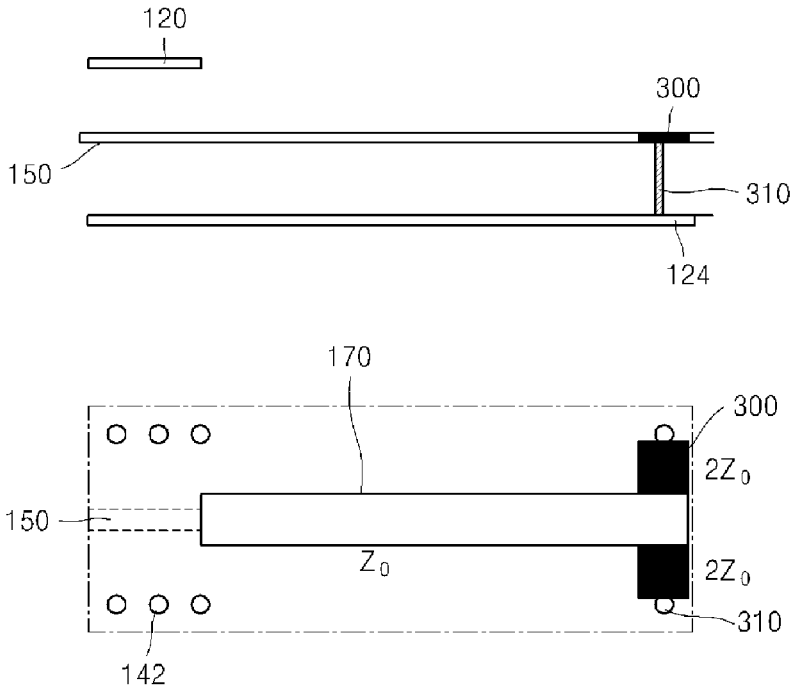
FIG. 3 illustrates a structure of a feeder termination unit of the slot antenna illustrated in FIG. 1, according to an embodiment of the present invention.

FIG. 3 illustrates a structure of the feeder termination unit of the slot antenna 100 illustrated in FIG. 1, according to an embodiment of the present invention.

Referring to FIG. 3, the TEM signal from the strip transmission line 150 is converted into the quasi-TEM signal in the micro-strip transmission line 170, and the quasi-TEM signal is dissipated by a termination resistor 300.

The termination resistor 300 is connected to a ground plane 124 via a ground via 310. An equivalent resistance of a plurality of termination resistors connected to each other in parallel may be equal to the characteristic impedance of the micro-strip transmission line 170. For example, when the characteristic impedance of a micro-strip transmission line is 50Ω and two termination resistors are used, the two termination resistors each have a resistance of 100Ω. If several termination resistors are used, inductance existing in the terminal resistors can be reduced, and thus an operating frequency of an antenna can be increased.

Figure 4:
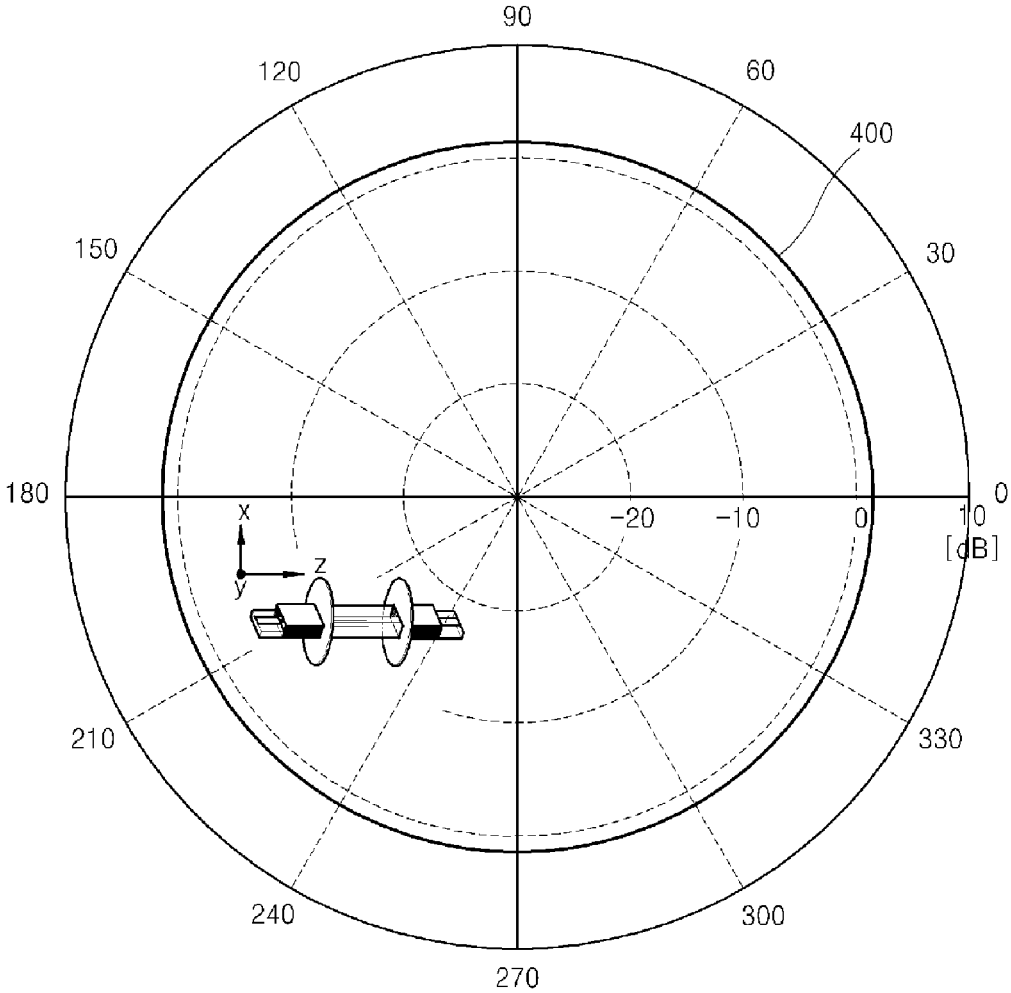
FIG. 4 illustrates a result of simulated a radiation pattern on a x-y plane of a slot antenna having stubs, according to an embodiment of the present invention.

FIG. 4 illustrates a result 400 of simulated radiation pattern on an x-y plane of a slot antenna having stubs, according to an embodiment of the present invention. Referring to FIG. 4, the simulation result 400 in the current embodiment is obtained on the premise that the frequency is 7 GHz and the stub interval (L) and the stub length (R) are each 10 mm. It can be seen from the simulation result 400 of FIG. 4 that the slot antenna radiates in an omnidirectional pattern.

Figure 5:
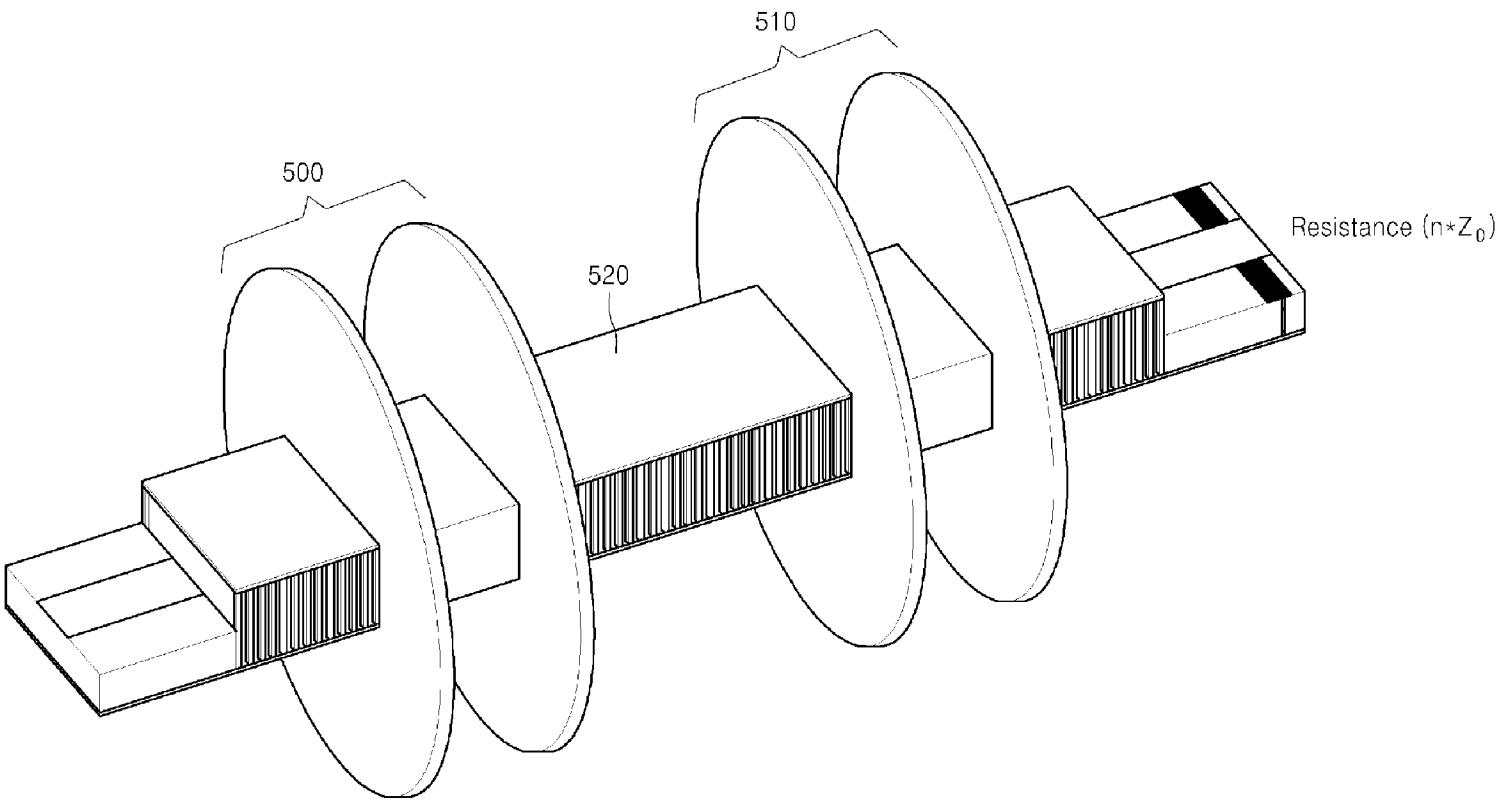
FIG. 5 is a perspective view of a slot antenna having a plurality of stubs, according to another embodiment of the present invention.

FIG. 5 is a perspective view of a slot antenna having a plurality of stubs, according to another embodiment of the present invention.

Comparing with the slot antenna 100 of FIG. 1, the slot antenna of FIG. 5 has four stubs, namely, first through fourth stubs. A slot is located in a space 500 between the first and second stubs, a slot is located in a space 510 between the third and fourth stubs, and a ground unit 520, instead of a slot, is located between the second and third stubs. Except this, both ends of the slot antenna according to the current embodiment have the same structure as that of FIG. 1. Due to the use of a plurality of stubs arranged as illustrated in FIG. 5, the directivity of the antenna is further improved.

As described above, a feeder termination unit has impedance that is the same as the characteristic impedance of a micro-strip transmission line, in order to prevent reflected waves from being generated due to impedance mismatching. When a plurality of resistors are installed in parallel to improve frequency characteristics, the resistance of each of the resistors is equal to the product of the number of resistors and the characteristic impedance of the micro-strip transmission line.

According to the present invention, signal feeding is achieved by a planar transmission line that transfers a quasi-TEM signal, for example, by a microstrip transmission line, and a connection of a feeder to a strip transmission line that transmits a TEM signal makes feeding and termination of one end of the feeder easy. Moreover, it is easy to both form a circuit for matching the impedance of an antenna with that of the feeder and implement an antenna integrated transceiver module.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A slot antenna having stubs, comprising:

a dielectric substrate in which a microstrip transmission line and a strip transmission line are formed;

ground planes located on upper and lower surfaces of the dielectric substrate at both ends of the strip transmission line and connected to each other via a plurality of ground vias; and at least one pair of stubs arranged at regular intervals on the dielectric substrate.

2. The slot antenna of claim 1, further comprising:

at least two termination resistors arranged in parallel at an end of the microstrip transmission line, wherein the total resistance of the termination resistors is matched to the impedance of the microstrip transmission line; and a ground via connecting the termination resistors to the ground plane located on the lower surface of the dielectric substrate.

3. The slot antenna of claim 1, wherein an interval between the pair of stubs and a length of each of the stubs are inversely proportional to an operating frequency.

4. The slot antenna of claim 1, wherein an interval between the ground vias is no more than 1/10 of a guided wavelength.

5. The slot antenna of claim 1, wherein the strip transmission line is constructed by using a multi-layered substrate so as to transfer a transverse electromagnetic mode (TEM) signal.

6. The slot antenna of claim 1, further comprising:

two pairs of stubs arranged at regular intervals on the dielectric substrate; and ground planes located on upper and lower surfaces of a portion of the dielectric substrate between one pair of the stubs and the other pair of the stubs and connected to each other via a plurality of ground vias.

* * * * *